US006874514B1

(12) United States Patent
Hoser et al.

(10) Patent No.: US 6,874,514 B1
(45) Date of Patent: Apr. 5, 2005

(54) CLEANING LIQUID RECEPTACLE WITH A FILTER ELEMENT FOR A CLEANING DEVICE

(75) Inventors: Jurgen Hoser, Neu-Anspach (DE); Alf Jahn, Halle/Saale (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/936,880

(22) PCT Filed: Mar. 2, 2000

(86) PCT No.: PCT/EP00/01789

§ 371 (c)(1),
(2), (4) Date: Sep. 17, 2001

(87) PCT Pub. No.: WO00/64300

PCT Pub. Date: Nov. 2, 2000

(30) Foreign Application Priority Data

Apr. 22, 1999 (DE) ..... 199 18 287

(51) Int. Cl.[7] ..... B08B 3/04

(52) U.S. Cl. ..... 134/109; 134/110; 134/186; 210/521; 210/532.1

(58) Field of Search ..... 210/521, 532.1; 139/109, 110, 132, 186, 155

(56) References Cited

U.S. PATENT DOCUMENTS

| | | | | | |
|---|---|---|---|---|---|
| 1,439,406 | A | * | 12/1922 | Elrod | 210/605 |
| 1,696,704 | A | * | 12/1928 | Grady | 424/637 |
| 1,826,015 | A | * | 10/1931 | Morton | |
| 1,899,657 | A | * | 2/1933 | Zademach | |
| 1,943,775 | A | * | 1/1934 | Taylor | |
| 2,229,640 | A | * | 1/1941 | Winford | 99/404 |
| 2,352,356 | A | * | 6/1944 | Albertson | |
| 2,538,285 | A | * | 1/1951 | Swayze | 209/269 |
| 2,799,645 | A | * | 7/1957 | Musgrove | 210/801 |
| 2,967,530 | A | * | 1/1961 | Shoemaker et al. | 134/13 |
| 3,580,261 | A | * | 5/1971 | Key | |
| 3,608,567 | A | * | 9/1971 | Neil, Jr. | |
| 3,841,116 | A | * | 10/1974 | Klein et al. | 68/12.13 |
| 3,871,914 | A | * | 3/1975 | Goffredo et al. | |
| 4,011,161 | A | * | 3/1977 | Popp et al. | 210/703 |
| 4,196,019 | A | * | 4/1980 | Kohler et al. | |
| 4,351,733 | A | * | 9/1982 | Salzer et al. | 210/738 |
| 4,362,625 | A | * | 12/1982 | Beard | 210/521 |
| 4,634,526 | A | * | 1/1987 | Salkeld et al. | 210/194 |
| 4,844,106 | A | * | 7/1989 | Hunter | |
| 4,895,652 | A | * | 1/1990 | Cornelissen | 210/320 |
| 5,054,506 | A | * | 10/1991 | Shakeri | |
| 5,100,545 | A | * | 3/1992 | Brooks | |
| 5,413,131 | A | * | 5/1995 | Medlock | |
| 5,976,268 | A | * | 11/1999 | Eliason et al. | |
| 6,164,298 | A | * | 12/2000 | Petter et al. | |

FOREIGN PATENT DOCUMENTS

| | | | |
|---|---|---|---|
| JP | 4-117406 | * | 4/1992 |
| JP | 6-170343 | * | 6/1994 |
| JP | 11-192493 | * | 7/1999 |
| WO | WO 98/35581 | | 8/1998 |

* cited by examiner

*Primary Examiner*—Frankie L. Stinson
(74) *Attorney, Agent, or Firm*—Fish & Richardson P.C.

(57) ABSTRACT

A cleaning liquid container for a cleaning device for cleaning objects for personal use, such as, the cutter head of a shaving apparatus. The cleaning liquid container includes an inlet, an outlet, and a filter element. In an interior of the cleaning liquid container, provision is made for a sedimentation line or flow path leading from the inlet to the outlet to allow solid particles to settle from the cleaning liquid.

80 Claims, 5 Drawing Sheets

CLEANING LIQUID RECEPTACLE WITH A FILTER ELEMENT FOR A CLEANING DEVICE

TECHNICAL FIELD

The invention relates to a cleaning liquid container for a cleaning device.

BACKGROUND

A cleaning liquid container is known from printed specification WO 98/35581. The replaceable cleaning liquid container filled with a cleaning liquid has an inlet and an outlet as well as a filter housing which projects into the cleaning liquid and is equipped with a filter element. Removably disposed in the interior of the filter housing are a conveying mechanism and a motor for driving the conveying mechanism. The solid particles which arise while cleaning a shaving head of a dry shaving apparatus flow with the cleaning liquid via the outlet into the interior of the cleaning liquid container and can be sucked up together with cleaning liquid by the conveying mechanism both before and after they settle to the bottom of the cleaning liquid container. In the course of being sucked up, these solid particles settle on the outer wall of the filter element, forming a so-called filter cake on the filter element and obstructing the sucking up of liquid by the conveying mechanism.

SUMMARY

An advantage of one aspect of the present invention is that the cleaning liquid, which is contaminated with solid particles as it flows back from a cleaning device, is directed via a sedimentation line or flow path leading from the inlet to the outlet in order to allow the entrained solid particles to settle. As the result of this flow path a large part of the solid particles settles from the cleaning liquid, forming a sediment trail along the flow path. Hence a major part of the solid particles does not reach the filter element, resulting in a significantly reduced amount of filter cake being formed on the filter element.

According to a preferred embodiment of the invention the flow path is formed by disposing at least one wall in the interior of the cleaning liquid container.

In a further aspect of this embodiment the wall is disposed between the inlet and the outlet to ensure a separation of inflowing cleaning liquid and of cleaning liquid adapted to be aspirated by a conveying mechanism.

According to another preferred embodiment, the length of the flow path is determined by the shaping of the wall.

In a further aspect of this embodiment the interior of the cleaning liquid container is divided by the wall into at least one first chamber and one second chamber, for the inlet to be assigned to the first chamber and the outlet to the second chamber, and for an opening to connect the first and the second chamber.

A preferred embodiment includes at least one partial wall provided in the interior of the cleaning liquid container.

In a further aspect of this embodiment the partial wall is provided in at least one first and/or one second chamber.

In a further embodiment the partial wall is provided in the opening which connects the first chamber to the second.

In another embodiment the partial wall is constructed as a rib.

According to another preferred embodiment wall elements are constructed as ribs on at least one inner wall of the cleaning liquid container.

In a further aspect of this embodiment the ribs are constructed as longitudinal partitions.

In a further embodiment the ribs are constructed as transverse partitions.

In another embodiment of the invention which is particularly suited for receiving and retaining segregated solid particles a honeycomb-type wall structure is formed by means of ribs.

In a further embodiment the honeycomb-type wall structure formed by means of ribs is disposed on the housing floor wall of the cleaning liquid container.

In a further embodiment of the invention at least one rib has comb teeth.

According to yet another embodiment of the invention ribs are provided on at least one longitudinal wall to allow solid particles to settle.

To create as long a sedimentation line or flow path as possible while using a wall element disposed in the interior of the cleaning liquid container, one embodiment of the invention provides for the inlet and the outlet to be disposed adjacent to each other in a common housing wall of the cleaning liquid container.

According to an alternative embodiment the inlet and the outlet are disposed in a spaced relationship to each other in a common housing wall of the cleaning liquid container, and at least two wall elements, each with at least one opening, are provided in the interior of the cleaning liquid container in order to form a long sedimentation line or flow path.

To facilitate settling of solid particles, e.g. stubble hairs, contained in a cleaning liquid, the interior of the cleaning liquid container is equipped with a filter element through which the cleaning liquid, having been used in several cleaning cycles, is aspirated by means of a conveying mechanism. To increase the number of cleaning cycles before the cleaning liquid container is replaced, the sedimentation or settling of solid particles on the way from the inlet to the filter element is effected by a sedimentation line or flow path which is formed by suitably constructed and disposed walls. As a result of the sedimentation a large part of the solid particles is separated from the cleaning liquid and hence does not reach the filter element and is unable therefore to form any filter cake there. The longer the sedimentation line, the fewer the solid particles which directly reach the filter element. Furthermore, the sedimentation of solid particles can be optimized by way of the number of partition-type and rib-type wall elements fitted within the sedimentation line and by their arrangement and construction.

On account of the cleaning process, the cleaning liquid flowing back into the cleaning liquid container contains not only solid particles but also small air bubbles. These air bubbles rise and leave the cleaning liquid as it proceeds along the flow path, enabling bubble-free cleaning liquid to be aspirated by the conveying mechanism and fed to the cleaning process.

Through the sedimentation of solid particles it is possible, with the same filter area, to significantly increase the number of cleaning cycles before needing to replace a cleaning liquid container because the filter cake, which in time blocks the filter element, forms more slowly. With solid particles settling and accumulating on the wall elements disposed to form the flow path, a substantially more efficient use of the cleaning liquid is ensured, particularly as the conveying mechanism can be immersed more deeply into the cleaning liquid container. Consequently, less than a third of the content of the cleaning liquid container remains in the cleaning liquid container for disposal when the cleaning liquid container is replaced after repeat use.

The sedimentation of solid particles is substantially promoted firstly by providing as long a flow path as possible for the cleaning liquid between the inlet, designed as the return opening, and the outlet, designed as the withdrawal opening. The arrangement of additional wall elements such as ribs and partitions in the interior of the cleaning liquid container causes the wall elements to act against the flow of the cleaning liquid, as the result of which the heavy constituents of the solid particles are separated from the liquid current. In addition it is possible to provide combtype wall elements within the flow path, which, in addition to the sedimentation line or flow path, encourage the settling of solid particles. These rib-type and partition-type wall elements make the cleaning liquid container more rigid on the whole, preventing the cleaning liquid container from being deformed, particularly in transit. The honeycomb structure provided on the housing floor wall lends optimal rigidity to the cleaning liquid container with a minimum of material outlay, in addition to resulting in maximal sedimentation as a result of the numerous ribs forming the honeycomb structure. Furthermore, the ribs of the honeycomb structure prevent the already deposited dirt from being moved with the liquid current toward the filter element.

DETAILED DESCRIPTION

Figure 1:
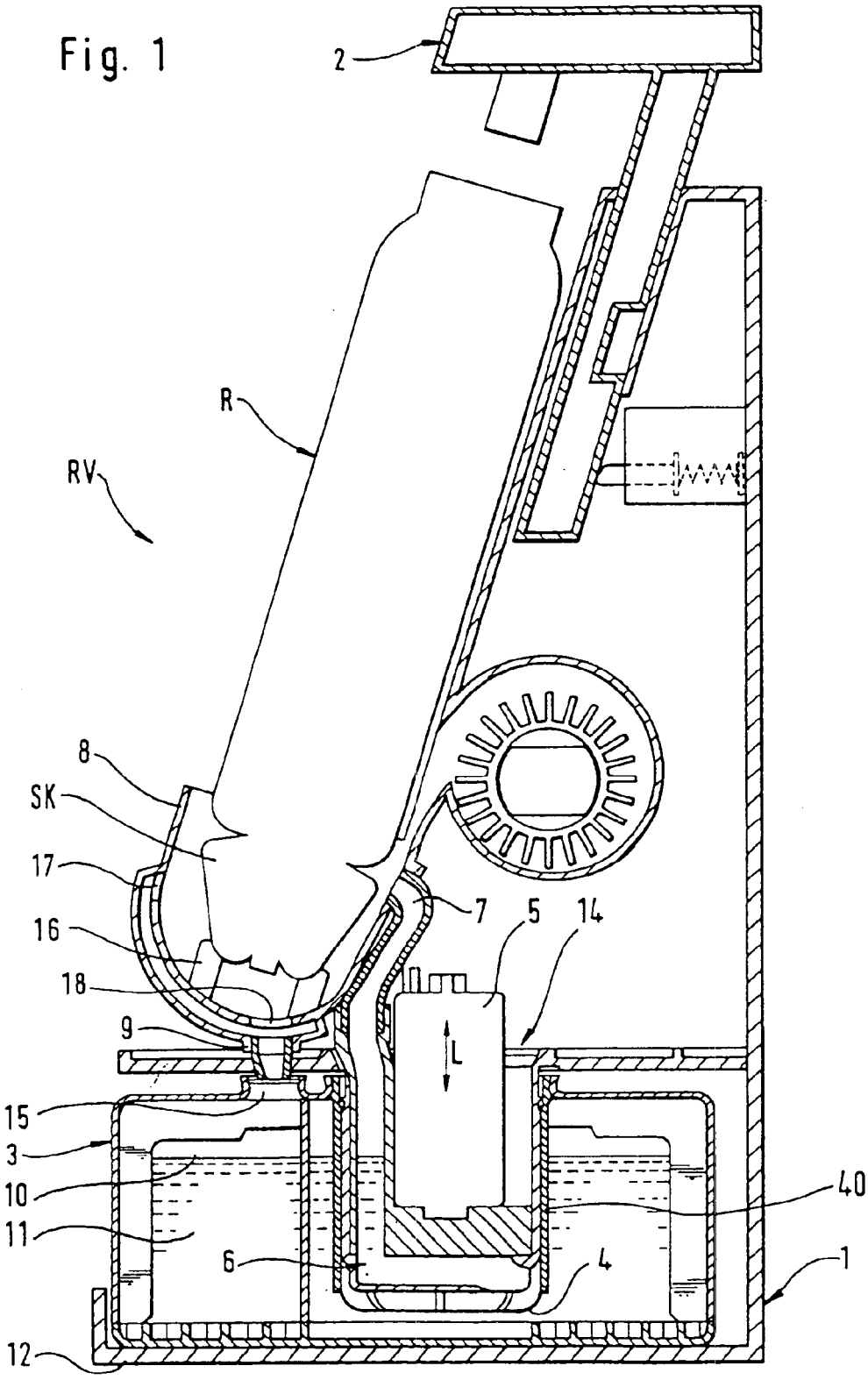
FIG. 1 is a cross-sectional side view of a cleaning device with a replaceable cleaning liquid container.

FIG. 1 shows a cleaning device RV for cleaning a shaving head SK of a shaving apparatus R. The cleaning device RV includes a housing 1, a holding device 2, a cleaning liquid container 3, a filter element 4, a conveying mechanism 6 adapted to be driven by a motor 5, a supply pipe 7 leading to a cleaning cradle 8, and a liquid discharge conduit 9 leading from the cleaning cradle 8 to a replaceable cleaning liquid container 3. The replaceable cleaning liquid container 3 has an integrated filter element 4 and is arranged beneath the cleaning cradle 8 and above a wall 12 of the housing 1. The conveying mechanism 6 with the motor 5 is disposed in the cleaning device RV so that it can be removed from a filter housing 40 provided in the interior 10 of the cleaning liquid container 3 and can be inserted in the filter housing 40.

The inner curved face of the cleaning cradle 8 is shaped to conform approximately to the outer contour of the shaving head SK of the dry shaving apparatus R and receives only as much cleaning liquid as required for the particular cleaning operation. To support the shaving head SK it is possible for the bottom of the cleaning cradle 8 to be provided, for example, with two support elements 16 made of an elastic material.

The cleaning cradle 8 has an overflow device 17 to ensure that the cleaning liquid 11 in the cleaning cradle 8 does not exceed a certain level. This assures that only the shaving head SK or a part of the shaving head SK is surrounded by cleaning liquid 11 when the cleaning device RV is in operation.

In this embodiment the liquid discharge conduit 9 from the cleaning cradle 8 to the cleaning liquid container 3 is formed by an outlet 18 in the cleaning cradle 8, whose cross-sectional area of discharge can also be used to control the level of the cleaning liquid 11 in the cleaning cradle 8, and by an inlet 15 of, for example, a funnel-shaped configuration in the cleaning liquid container 3. The inlet 15 and the outlet 14 of the cleaning liquid container 3 can be closed by means of a closure—not shown—in order, for example, to transport the replaceable cleaning liquid container 3.

Figure 2:
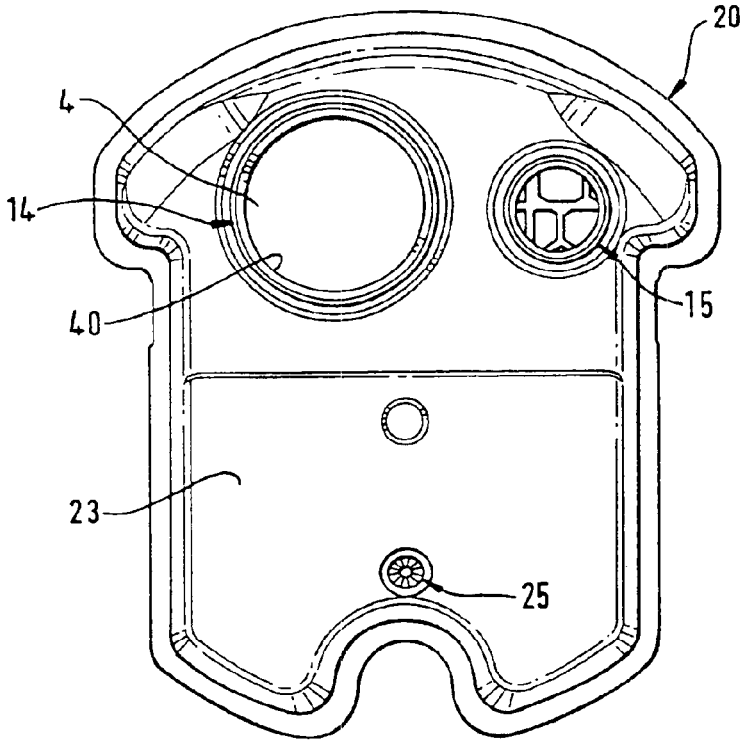
FIG. 2 is a top view of the upper housing wall of the cleaning liquid container showing an inlet and an outlet.

FIG. 2 shows a view of the housing wall 23 of the housing 20 of the cleaning liquid container 3. The inlet 15 and the outlet 14 are disposed adjacent to each other in the housing wall 23. The housing wall also includes a filling opening 25 to fill the cleaning liquid container 3 with cleaning liquid 11 when the inlet 15 and the outlet 14 are closed by a closure. After the cleaning liquid container 3 is filled with cleaning liquid 11 the filling opening 25 is closed by means of a plug, for example. Through the outlet 14 in the open state it is possible to see the cylindrically constructed wall of the filter housing 40 and the filter element 4 fastened to the end of the filter housing 40. Through the inlet 15 in the open state it is possible to see the housing floor wall 21 (shown in FIG. 5), equipped with ribs 32, 33, 36, (shown in FIG. 5) of the cleaning liquid container 3.

Figure 3:
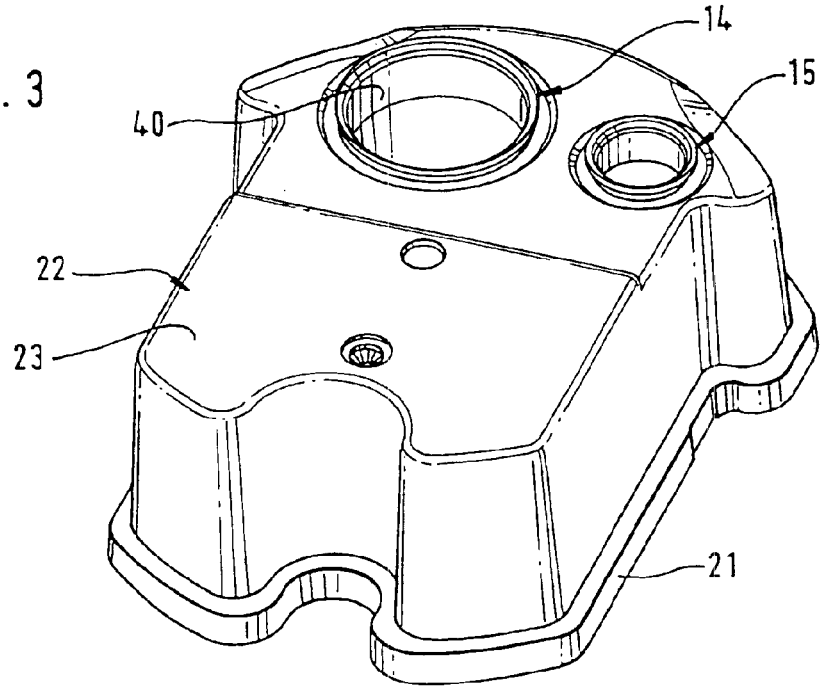
FIG. 3 is a perspective view of a cleaning liquid container with an inlet and an outlet.

FIG. 3 shows a perspective view of the replaceable cleaning liquid container 3. The housing floor wall 21 is fastened to the housing pot 22. The inlet 15 and the outlet 14 are situated in the upper housing wall 23.

Figure 4:
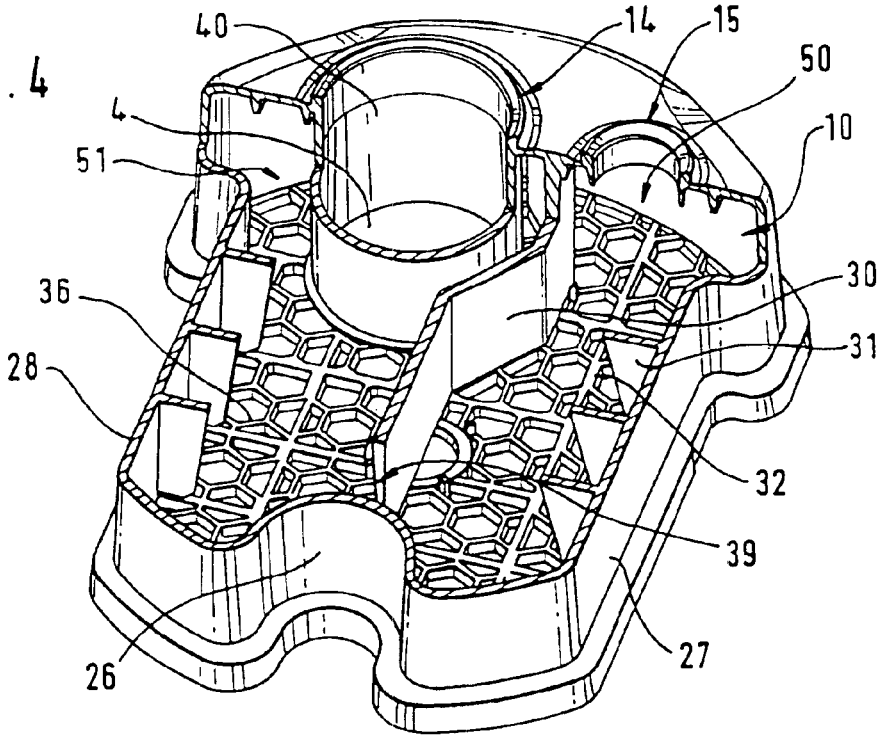
FIG. 4 is a perspective view of the cleaning liquid container of FIG. 3 showing a partial section through the upper housing wall, two longitudinal walls and a transverse wall connecting these, and through a wall element.

FIG. 4 shows a partial section through the upper housing wall 23 and through three of the circumferential side walls of the housing pot 22, namely the longitudinal walls 27 and 28 and the transverse wall 26 of the cleaning liquid container 3. The partial section also runs through the middle of the outlet 14 serving as the withdrawal opening and through the filter housing 40 as well as through the inlet 15 serving as the return opening.

The interior 10 of the cleaning liquid container 3 is divided by a wall 30 into a first chamber 50 acting as an inflow compartment and a second chamber 51 acting as a suction compartment. The wall 30 ends at a predetermined distance A (shown in FIG. 8) from the transverse wall 26 of the cleaning liquid container 3, thereby forming an opening 39 through which the cleaning liquid 11 is allowed to flow on its way from the inlet 15 associated with the first chamber 50 to the outlet 14 associated with the second chamber 51.

In the interior 10 of the cleaning liquid container 3 further wall elements are provided along the sedimentation line or flow path leading from the inlet 15 to the outlet 14. These wall elements encourage solid particles to settle from the cleaning liquid 11. These wall elements are essentially constructed as ribs or partitions 31, 32, 33 and 36. Using the ribs 32, 33 and 36 it is possible to obtain various wall structures on the inner surface of the housing floor wall 21 of the cleaning liquid container 3.

Figure 5:
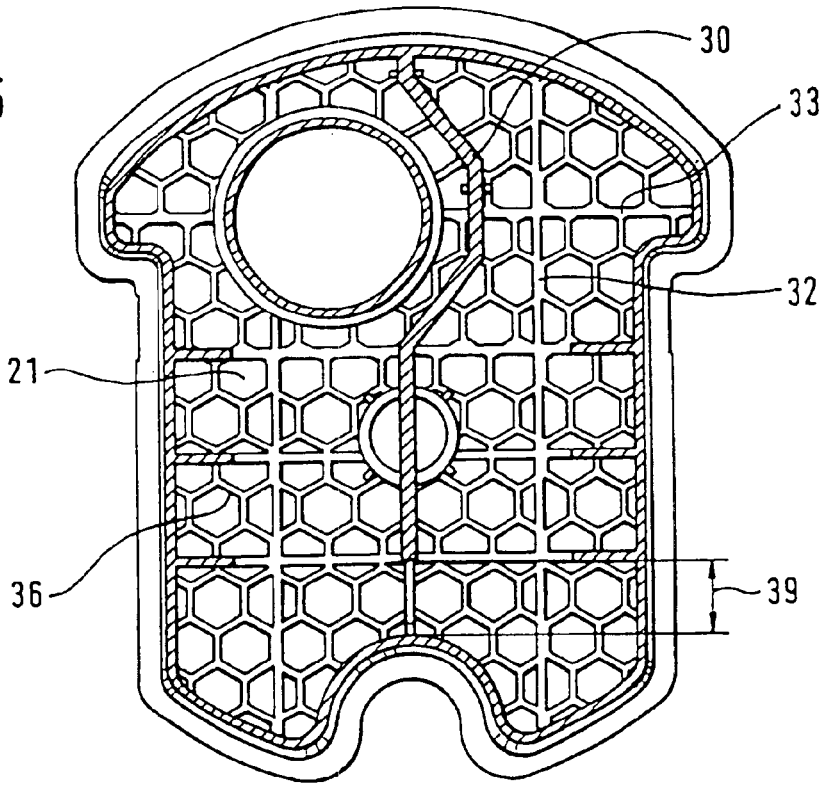
FIG. 5 is a top view of the housing floor wall equipped with a honeycomb-type wall structure and longitudinal partitions and transverse partitions.

The embodiment of FIG. 5 shows, by way of example, a combination of two different wall structures, namely a honeycomb-type wall structure obtained by means of the ribs 36 and having through ribs 32 and 33 constructed as longitudinal partitions and transverse partitions. The ribs 32, 33 and 36 have a relatively low height. The ribs 32, 33, and 36 form depressions in which the solid particles from the cleaning liquid 11 can settle and be retained by the ribs 32, 33 and 36.

The wall elements constructed as ribs 31 (shown in FIG. 4) are formed integrally with the longitudinal walls 27 and 28 of the cleaning liquid container 3. The ribs 31 may extend, for example, as far as the transverse partitions 33 on the housing floor wall 21 (shown in FIG. 5). The ribs 31 also encourage sedimentation, i.e., the separation of solid particles from the liquid 11.

The wall 30, which forms the sedimentation line or flow path and, by virtue of its shape, simultaneously determines the length of the sedimentation line or flow path, is fastened partly to the inner surface of the housing wall 23 of the housing pot 22 and partly to the housing floor wall 21 of the housing bottom. The wall 30 is attached to the housing wall 23 and housing floor wall 21 such that a single-piece wall 30 is formed after the housing pot 22 is joined to the housing floor wall 21 and a tight connection is subsequently made as by adhesive bonding and/or welding. The wall 30, provided as a partition wall, may be formed integrally with the housing pot 22 or with the housing floor wall 21. It will be understood that the shape of the wall 30 is not restricted to the form illustrated in FIGS. 4 and 5. The length of extension of the wall 30 may be varied, preferably extended, and with it the length of the sedimentation line or flow path may be extended by giving it a different shape, e.g. a sinuous shape.

Figure 6:
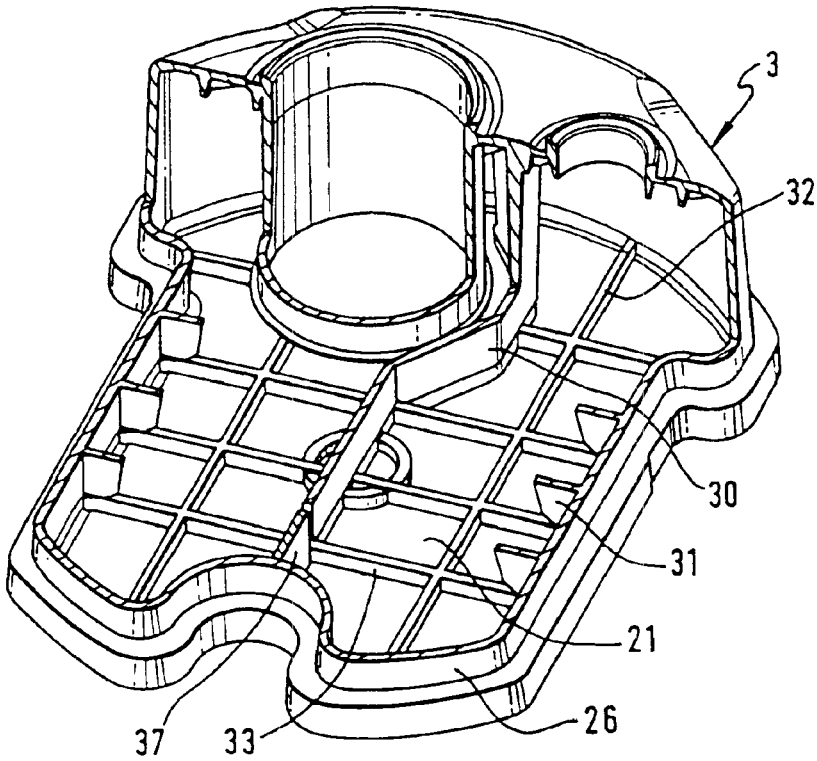
FIG. 6 is a perspective partial sectional view of a cleaning liquid container of FIG. 4 having a housing floor wall equipped with longitudinal partitions and transverse partitions.

The embodiment of the cleaning liquid container 3 of FIG. 6 differs from the embodiment of FIG. 4 in that the housing floor wall 21 is equipped with a rectangular wall structure made of ribs 32 and 33.

On the housing floor wall 21 a wall element constructed as a rib 37 is provided in the opening 39 between the wall 30 and the transverse wall 26 in such a way that a partial wall 34 (shown in FIGS. 6, 9 and 10) is formed in the opening 39 (shown in FIG. 4) The partial wall 34 traps any solid particles contained in the liquid 11 which are already at a level in the liquid flow that is below the top of the partial wall 34.

Figure 7:
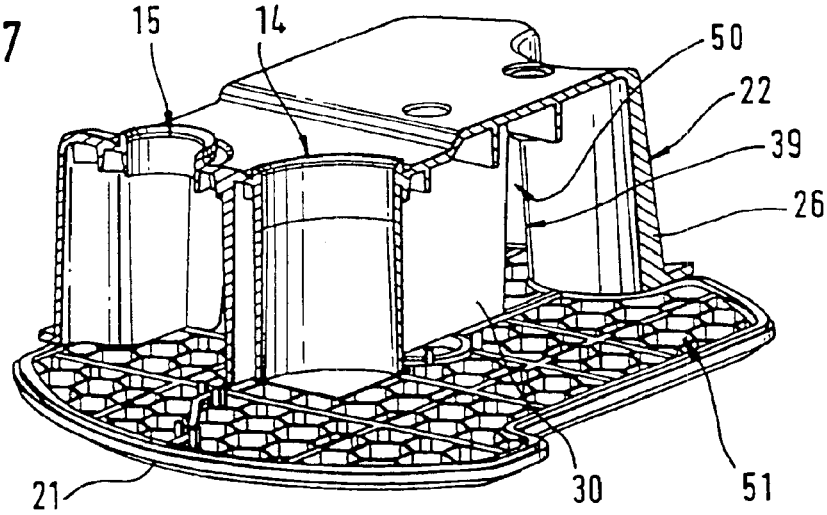
FIG. 7 is a perspective partial sectional view of a cleaning liquid container showing in longitudinal section and cross section the housing pot arranged on the housing floor wall.

FIG. 7 shows a section through the housing pot 22 disposed on the housing floor wall 21, namely through the inlet 15, the outlet 14, and through walls of the second chamber 51. The opening 39 provided between the transverse wall 26 and the wall 30 extends as far as the honeycomb-type wall structure formed by the ribs 36, 32 and 33. The opening 39 provides a passage way from the second chamber 51 into the first chamber 50.

Figure 8:
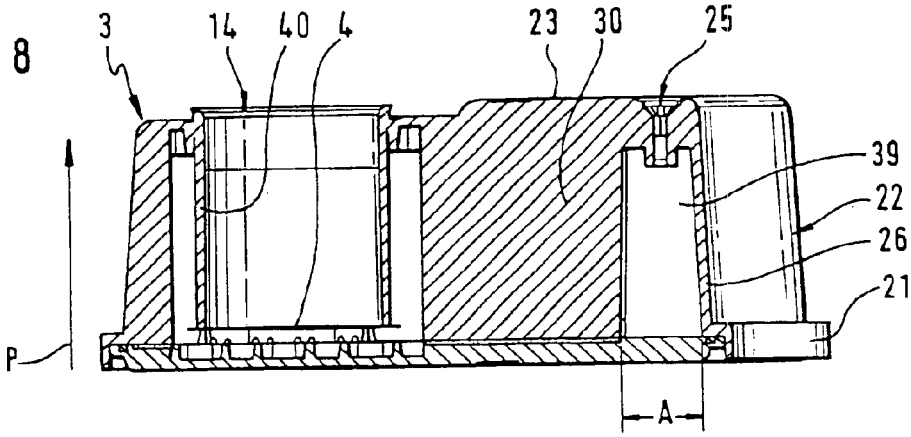
FIG. 8 is a side cross-sectional view of the cleaning liquid container, taken through the filter housing and an opening for the passage of a cleaning liquid.

FIG. 8 shows a longitudinal section through a cleaning liquid container 3, namely through the circumferential side wall of the housing pot 22, through the wall of the filter housing 40, through the wall element 30, and through the housing floor wall 21. A wall structure made of wall elements in the form of ribs and/or partitions 32, 33, 36 is formed integrally with the housing floor wall 21 in the area of the filter housing 40. The filter housing 40 ends a relatively short distance from the housing floor wall 21. A filter element 4 closes the end of the filter housing 40 on the side close to the housing floor wall 21. A predetermined distance of the filter housing 40 and hence of the filter element 4 to the opposite housing floor wall 21 ensures that a sufficient amount of cleaning liquid 11 can be aspirated by the conveying mechanism 6 (shown in FIG. 1) and fed to the cleaning cradle 8 via the supply pipe 7 (shown in FIG. 1).

In the embodiment of FIG. 8 the opening 39 formed by the transverse wall 26 and the wall 30 extends in vertical direction P from the housing floor wall 21 as far as the upper housing wall 23, in which the filling opening 25 is provided.

Figure 9:
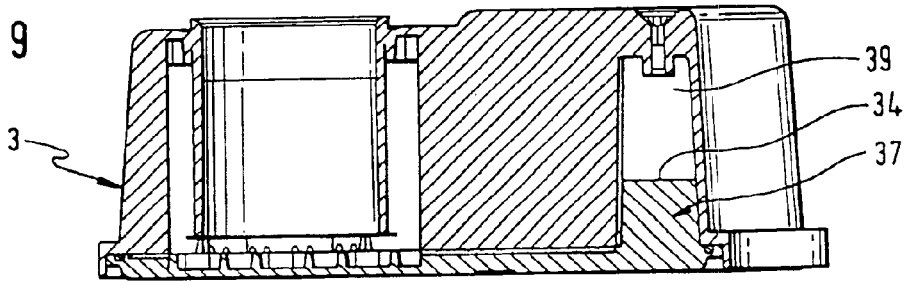
FIG. 9 is a side cross-sectional view of the cleaning liquid container, taken through the filter housing and an opening for the passage of a cleaning liquid and an overflow wall provided in the opening.
Figure 10:
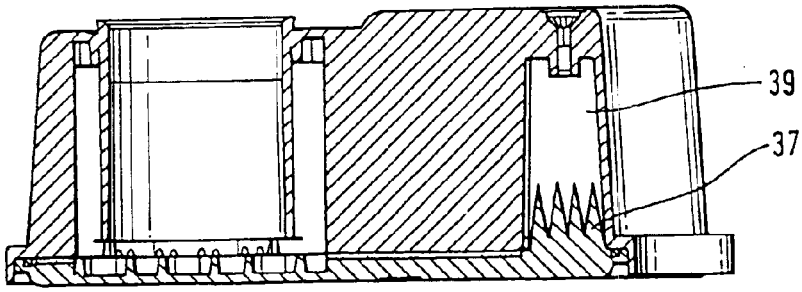
FIG. 10 is a side cross-sectional view of the cleaning liquid container, taken through the filter housing and an opening for the passage of a cleaning liquid and an overflow wall with comb teeth, which is provided in the opening.

Unlike the embodiment of a cleaning liquid container 3 according to FIG. 8, in the embodiment of FIG. 9 the partial wall 34 formed by a rib 37 is provided in the opening 39 formed by the wall element 30 and the transverse wall 26. The partial wall 34 extends from the housing floor wall 21 toward the filling opening 25 in a vertical direction P. Unlike the embodiment of FIG. 9, the partial wall 34 formed as rib 37, as shown in FIG. 10, is equipped with comb teeth.

What is claimed is:

1. A cleaning liquid container for a cleaning device for cleaning an object for personal use, the liquid container comprising:

a housing defining an interior cavity;

an inlet defined by the housing, the inlet receiving a cleaning fluid carrying solid particles from the cleaning device into the interior cavity;

an outlet through which the cleaning fluid is returned to the cleaning device for further cleaning of the object for personal use;

a filter arranged along a flow path of the cleaning fluid between the inlet and the outlet; and an interior wall extending along the interior cavity, the interior wall being arranged to lengthen the flow path of the cleaning fluid between the inlet and the outlet, and to direct the flow path across multiple ribs extending upward from a floor wall of the cavity and defining particle retention pockets therebetween to promote settling of the solid particles carried by the cleaning fluid in the particle retention pockets, at least some of the multiple ribs having a substantially non-parallel orientation relative to the interior wall.

2. The cleaning liquid container as claimed in claim 1, wherein the interior cavity is divided by the interior wall into at least one first chamber and one second chamber, the inlet being assigned to the first chamber and the outlet being assigned to the second chamber, and an opening, which connects the first and the second chambers, being provided in the flow path between the inlet and the outlet.

3. The cleaning liquid container as claimed in claim 2, including a partial wall extending upward from a lower surface of the interior cavity along the flow path.

4. The cleaning liquid container as claimed in claim 3, wherein the partial wall is provided in at least one of the first and second chambers.

5. The cleaning liquid container as claimed in claim 3, wherein the partial wall is provided in the opening which connects the first chamber to the second chamber.

6. The cleaning liquid container as claimed in claim 3, wherein the partial wall is constructed as a rib.

7. The cleaning liquid container as claimed in claim 6, wherein wall elements constructed as ribs are provided on at least one inner wall of the cleaning liquid container.

8. The cleaning liquid container as claimed in claim 7, wherein the ribs are constructed as longitudinal partitions.

9. The cleaning liquid container as claimed in claim 7, wherein the ribs are constructed as transverse partitions.

10. The cleaning liquid container as claimed in claim 7, wherein a honeycomb-type wall structure is formed by means of ribs.

11. The cleaning liquid container as claimed in claim 10, wherein the honeycomb-type wall structure formed by means of ribs is disposed on the housing floor wall.

12. The cleaning liquid container as claimed in claim 7, wherein at least one rib has comb teeth.

13. The cleaning liquid container as claimed in claim 1, wherein the object for personal use is the cutter head of a shaving apparatus.

14. The cleaning liquid container as claimed in claim 13, wherein provision is made for ribs on at least one longitudinal wall.

15. The cleaning liquid container as claimed in claim 13, wherein the inlet and the outlet are disposed adjacent to each other in a common housing wall of the cleaning liquid container.

16. The cleaning liquid container as claimed in claim 13, wherein the inlet and the outlet are disposed in a spaced relationship to each other in a common housing wall of the cleaning liquid container, and at least two wall elements, each with at least one opening, are provided in order to form a long sedimentation line.

17. A cleaning liquid container for a cleaning device for cleaning a cutter head of a shaving apparatus, the liquid container comprising:

a housing defining an interior cavity;

an inner wall within the interior cavity, the inner wall having ribs extending therefrom to define particle retention pockets, the inner wall being arranged to lengthen a flow path of a cleaning liquid, and to direct the flow path across the ribs;

an inlet defined by the housing of the cleaning liquid container;

an outlet defined by the housing; and a filter arranged along the flow path of the cleaning liquid within the interior cavity, the flow path leading from the inlet to the outlet to allow solid particles to settle from the cleaning liquid in the particle retention pockets.

18. The cleaning liquid container as claimed in claim 17, wherein the ribs are longitudinal partitions.

19. The cleaning liquid container as claimed in claim 17, wherein the ribs are transverse partitions.

20. The cleaning liquid container as claimed in claim 17, wherein the ribs form a honeycomb-type wall structure.

21. The cleaning liquid container as claimed in claim 20, wherein the honeycomb-type wall structure is disposed on a floor wall of the housing.

22. The cleaning liquid container as claimed in claim 17 wherein at least one of the ribs has comb teeth.

23. A cleaning liquid container for a cleaning device for cleaning a cutter head of a shaving apparatus, the liquid container comprising:

a housing defining an interior cavity;

a longitudinal wall having ribs extending therefrom, the ribs defining particle retention pockets, the longitudinal wall being disposed in the interior cavity, and the longitudinal wall being arranged to lengthen the flow path of a cleaning liquid and to direct the flow path across the ribs;

an inlet defined by the housing of the cleaning liquid container;

an outlet defined by the housing; and a filter arranged along the flow path of the cleaning liquid within the interior cavity, the flow path leading from the inlet to the outlet to allow solid particles to settle from the cleaning liquid in the particle retention pockets.

24. The cleaning liquid container as claimed in claim 23, wherein the ribs are constructed as longitudinal partitions.

25. The cleaning liquid container as claimed in claim 23, wherein the ribs are constructed as transverse partitions.

26. The cleaning liquid container as claimed in claim 23, wherein a honeycomb-type wall structure is formed by means of ribs.

27. The cleaning liquid container as claimed in claim 23 wherein at least one rib has comb teeth.

28. The cleaning liquid container as claimed in claim 23, wherein the inlet and the outlet are disposed adjacent to each other in a common housing wall of the cleaning liquid container.

29. A cleaning liquid container for a cleaning device for cleaning a cutter head of a shaving apparatus, the liquid container comprising:

a housing defining an interior cavity;

an inlet defined by a first wall of the housing of the cleaning liquid container;

an outlet disposed adjacent the inlet, the outlet being defined by the first wall of the housing;

a second wall disposed within the interior cavity, the second wall being arranged to lengthen a flow path of a cleaning liquid and to direct the flow path across multiple ribs extending upward from a floor wall of the cavity and defining particle retention pockets therebetween, at least some of the multiple ribs having a substantially non-parallel orientation relative to the second wall; and a filter arranged along the flow path of the cleaning liquid within the interior cavity, the flow path leading from the inlet to the outlet to allow solid particles to settle from the cleaning liquid in the particle retention pockets.

30. The cleaning liquid container as claimed in claim 29, wherein the ribs are constructed as longitudinal partitions.

31. The cleaning liquid container as claimed in claim 29, wherein the ribs are constructed as transverse partitions.

32. The cleaning liquid container as claimed in claim 29, wherein a honeycomb-type wall structure is formed by means of ribs.

33. The cleaning liquid container as claimed in claim 29, wherein at least one rib has comb teeth.

34. The cleaning liquid container as claimed in claim 29, wherein provision is made for ribs on at least one longitudinal wall.

35. A cleaning liquid container for a cleaning device for cleaning a cutter head of a shaving apparatus, the liquid container comprising:

a housing defining an interior cavity;

an inlet defined by a wall of the housing of the cleaning liquid container;

an outlet disposed in a spaced relationship to the inlet, the outlet being defined by the wall of the housing; and at least two walls in the interior cavity, each wall having at least one opening, the walls being arranged to lengthen a flow path of a cleaning liquid and to direct the flow path across multiple ribs extending upward from a floor wall of the cavity and defining particle retention pockets therebetween, the flow path leading from the inlet to the outlet to allow solid particles to settle from the cleaning liquid in the particle retention pockets; and a filter arranged along the flow path of the cleaning liquid.

36. The cleaning liquid container as claimed in claim 35, wherein the ribs are constructed as longitudinal partitions.

37. The cleaning liquid container as claimed in claim 35, wherein the ribs are constructed as transverse partitions.

38. The cleaning liquid container as claimed in claim 35, wherein a honeycomb-type wall structure is formed by means of ribs.

39. The cleaning liquid container as claimed in claim 35, wherein at least one rib has comb teeth.

40. A cleaning liquid container for a cleaning device for cleaning a cutter head of a shaving apparatus, the liquid container comprising:

a housing defining an interior cavity;

an inlet defined by the housing, the inlet receiving a cleaning fluid carrying solid particles from the cleaning device into the interior cavity;

an outlet through which the cleaning fluid is returned to the cleaning device for further cleaning of the object for personal use;

a filter arranged along a flow path of the cleaning fluid between the inlet and the outlet;

an interior wall extending along the interior cavity, the interior wall being arranged to lengthen the flow path of the cleaning fluid between the inlet and the outlet to promote settling of the solid particles carried by the cleaning fluid within the interior cavity; and a honeycomb-type wall structure formed by means of ribs disposed on a floor wall of the housing.

41. The cleaning liquid container as claimed in claim 40, wherein the interior cavity is divided by the interior wall into at least one first chamber and one second chamber, the inlet being assigned to the first chamber and the outlet being assigned to the second chamber, and an opening, which connects the first and the second chambers, being provided in the flow path between the inlet and the outlet.

42. The cleaning liquid container as claimed in claim 41, including a partial wall extending upward from a lower surface of the interior cavity along the flow path.

43. The cleaning liquid container as claimed in claim 42, wherein the partial wall is provided in at least one of the first and second chambers.

44. The cleaning liquid container as claimed in claim 42, wherein the partial wall is provided in the opening which connects the first chamber to the second chamber.

45. The cleaning liquid container as claimed in claim 42, wherein the partial wall is constructed as a rib.

46. A cleaning liquid container for a cleaning device for cleaning a cutter head of a shaving apparatus, the liquid container comprising:

a housing defining an interior cavity;

a floor wall within the interior cavity, the floor wall having ribs extending therefrom, wherein the ribs form a honeycomb-type wall structure;

an inlet defined by the housing of the cleaning liquid container;

an outlet defined by the housing; and a filter arranged along a flow path of a cleaning liquid within the interior cavity, the flow path leading from the inlet to the outlet to allow solid particles to settle from the cleaning liquid.

47. The cleaning liquid container as claimed in claim 46, wherein provision is made for ribs on at least one longitudinal wall.

48. The cleaning liquid container as claimed in claim 46, wherein the inlet and the outlet are disposed adjacent to each other in a common housing wall of the cleaning liquid container.

49. A cleaning liquid container for a cleaning device for cleaning a cutter head of a shaving apparatus, the liquid container comprising:

a housing defining an interior cavity;

an inlet defined by the housing, the inlet receiving a cleaning fluid carrying shaving particles from the cleaning device into the interior cavity;

an outlet through which the cleaning fluid is returned to the cleaning device for further cleaning of the cutter head of the shaving apparatus;

a filter arranged along a flow path of the cleaning fluid between the inlet and the outlet;

an interior wall extending along the interior cavity, the interior wall being arranged to lengthen the flow path of the cleaning fluid between the inlet and the outlet to promote settling of the shaving particles carried by the cleaning fluid within the interior cavity; and ribs on at least one inner wall of the cleaning liquid container, at least some of the ribs having a substantially nonparallel orientation relative to the interior wall.

50. The cleaning liquid container as claimed in claim 49, wherein the interior cavity is divided by the interior wall into at least one first chamber and one second chamber, the inlet being assigned to the first chamber and the outlet being assigned to the second chamber, and an opening, which connects the first and the second chambers, being provided in the flow path between the inlet and the outlet.

51. The cleaning liquid container as claimed in claim 50, including a partial wall extending upward from a lower surface of the interior cavity along the flow path.

52. The cleaning liquid container as claimed in claim 51, wherein the partial wall is provided in at least one of the first and second chambers.

53. The cleaning liquid container as claimed in claim 51, wherein the partial wall is provided in the opening which connects the first chamber to the second chamber.

54. The cleaning liquid container as claimed in claim 51, wherein the partial wall is constructed as a rib.

55. The cleaning liquid container as claimed in claim 49, wherein the ribs are constructed as longitudinal partitions.

56. The cleaning liquid container as claimed in claim 49, wherein the ribs are constructed as transverse partitions.

57. The cleaning liquid container as claimed in claim 49, wherein a honeycomb-type wall structure is formed by means of ribs.

58. The cleaning liquid container as claimed in claim 49, wherein at least one rib has comb teeth.

59. A cleaning liquid container for a cleaning device for cleaning an object for personal use, the liquid container comprising:

a housing defining an interior cavity;

an inlet defined by the housing, the inlet receiving a cleaning fluid carrying solid particles from the cleaning device into the interior cavity;

an outlet through which the cleaning fluid is returned to the cleaning device for further cleaning of the object for personal use;

a filter arranged along a flow path of the cleaning fluid between the inlet and the outlet;

an interior wall extending along the interior cavity, the interior wall being arranged to lengthen the flow path of the cleaning fluid between the inlet and the outlet, and to direct the flow path across multiple ribs extending upward from a floor wall of the cavity and defining particle retention pockets therebetween to promote settling of the solid particles carried by the cleaning fluid in the particle retention pockets, wherein the interior cavity is divided by the interior wall into at least one first chamber and one second chamber, the inlet being assigned to the first chamber and the outlet being assigned to the second chamber, and an opening, which connects the first and the second chambers, being provided in the flow path between the inlet and the outlet; and a partial wall extending upward from a lower surface of the interior cavity along the flow path.

60. The cleaning liquid container as claimed in claim 59, wherein the partial wall is provided in at least one of the first and second chambers.

61. The cleaning liquid container as claimed in claim 59, wherein the partial wall is provided in the opening which connects the first chamber to the second chamber.

62. The cleaning liquid container as claimed in claim 59, wherein the partial wall is constructed as a rib.

63. A cleaning liquid container for a cleaning device for cleaning a cutter head of a shaving apparatus, the liquid container comprising:

a housing defining an interior cavity;

an inlet defined by the housing, the inlet receiving a cleaning fluid carrying solid particles from the cleaning device into the interior cavity;

an outlet through which the cleaning fluid is returned to the cleaning device for further cleaning of the object for personal use;

a filter arranged along a flow path of the cleaning fluid between the inlet and the outlet;

an interior wall extending along the interior cavity, the interior wall being arranged to lengthen the flow path of the cleaning fluid between the inlet and the outlet, and to direct the flow path across multiple ribs extending upward from a floor wall of the cavity and defining particle retention pockets therebetween to promote settling of the solid particles carried by the cleaning fluid in the particle retention pockets; and wall elements constructed as ribs on at least one inner wall of the cleaning liquid container.

64. The cleaning liquid container as claimed in claim 63, wherein the ribs are constructed as longitudinal partitions.

65. The cleaning liquid container as claimed in claim 63, wherein the ribs are constructed as transverse partitions.

66. The cleaning liquid container as claimed in claim 63 wherein a honeycomb-type wall structure is formed by means of ribs.

67. The cleaning liquid container as claimed in claim 66, wherein the honeycomb-type wall structure formed by means of ribs is disposed on the housing floor wall.

68. The cleaning liquid container as claimed in claim 63, wherein at least one rib has comb teeth.

69. A cleaning liquid container for a cleaning device for cleaning a cutter head of a shaving apparatus, the liquid container comprising:

a housing defining an interior cavity;

an inlet defined by the housing, the inlet receiving a cleaning fluid carrying solid particles from the cleaning device into the interior cavity;

an outlet through which the cleaning fluid is returned to the cleaning device for further cleaning of the cutter head;

a filter arranged along a flow path of the cleaning fluid between the inlet and the outlet;

an interior wall extending along the interior cavity, the interior wall being arranged to lengthen the flow path of the cleaning fluid between the inlet and the outlet, and to direct the flow path across multiple ribs extending upward from a floor wall of the cavity and defining particle retention pockets therebetween to promote settling of the solid particles carried by the cleaning fluid in the particle retention pockets; and ribs on at least one longitudinal wall.

70. A cleaning liquid container for a cleaning device for cleaning a cutter head of a shaving apparatus, the liquid container comprising:

a housing defining an interior cavity;

an inlet defined by a housing wall, the inlet receiving a cleaning fluid carrying solid particles from the cleaning device into the interior cavity;

an outlet through which the cleaning fluid is returned to the cleaning device for further cleaning of the cutter head, the outlet being disposed adjacent the inlet in the housing wall;

a filter arranged along a flow path of the cleaning fluid between the inlet and the outlet; and an interior wall extending along the interior cavity, the interior wall being arranged to lengthen the flow path of the cleaning fluid between the inlet and the outlet, and to direct the flow path across multiple ribs extending upward from a floor wall of the cavity and defining particle retention pockets therebetween to promote settling of the solid particles carried by the cleaning fluid in the particle retention pockets.

71. A cleaning liquid container for a cleaning device for cleaning a cutter head of a shaving apparatus, the liquid container comprising:

a housing defining an interior cavity;

an inlet defined by the housing, the inlet receiving a cleaning fluid carrying solid particles from the cleaning device into the interior cavity;

an outlet through which the cleaning fluid is returned to the cleaning device for further cleaning of the cutter head;

a filter arranged along a flow path of the cleaning fluid between the inlet and the outlet; and an interior wall extending along the interior cavity, the interior wall being arranged to lengthen the flow path of the cleaning fluid between the inlet and the outlet, and to direct the flow path across multiple ribs extending upward from a floor wall of the cavity and defining particle retention pockets therebetween to promote settling of the solid particles carried by the cleaning fluid in the particle retention pockets;

wherein the inlet and the outlet are disposed in a spaced relationship to each other in a common housing wall of the cleaning liquid container, and at least two wall elements, each with at least one opening, are provided in order to form a long sedimentation line.

72. A cleaning liquid container for a cleaning device for cleaning a cutter head of a shaving apparatus, the liquid container comprising:

a housing defining an interior cavity;

an inlet defined by the housing, the inlet receiving a cleaning fluid carrying shaving particles from the cleaning device into the interior cavity;

an outlet through which the cleaning fluid is returned to the cleaning device for further cleaning of the cutter head of the shaving apparatus;

a filter arranged along a flow path of the cleaning fluid between the inlet and the outlet;

an interior wall extending along the interior cavity, the interior wall being arranged to lengthen the flow path of the cleaning fluid between the inlet and the outlet to promote settling of the shaving particles carried by the cleaning fluid within the interior cavity, wherein the interior cavity is divided by the interior wall into at least one first chamber and one second chamber, the inlet being assigned to the first chamber and the outlet being assigned to the second chamber, and an opening, which connects the first and the second chambers, being provided in the flow path between the inlet and the outlet;

wall elements constructed as ribs on at least one inner wall of the cleaning liquid container; and a partial wall extending upward from a lower surface of the interior cavity along the flow path.

73. The cleaning liquid container as claimed in claim 72, wherein the partial wall is provided in at least one of the first and second chambers.

74. The cleaning liquid container as claimed in claim 72, wherein the partial wall is provided in the opening which connects the first chamber to the second chamber.

75. The cleaning liquid container as claimed in claim 72, wherein the partial wall is constructed as a rib.

76. A cleaning liquid container for a cleaning device for cleaning a cutter head of a shaving apparatus, the liquid container comprising:

a housing defining an interior cavity;

an inlet defined by the housing, the inlet receiving a cleaning fluid carrying shaving particles from the cleaning device into the interior cavity;

an outlet through which the cleaning fluid is returned to the cleaning device for further cleaning of the cutter head of the shaving apparatus;

a filter arranged along a flow path of the cleaning fluid between the inlet and the outlet;

an interior wall extending along the interior cavity, the interior wall being arranged to lengthen the flow path of the cleaning fluid between the inlet and the outlet to promote settling of the shaving particles carried by the cleaning fluid within the interior cavity; and wall elements constructed as ribs on at least one inner wall of the cleaning liquid container, the ribs being constructed as longitudinal partitions.

77. A cleaning liquid container for a cleaning device for cleaning a cutter head of a shaving apparatus, the liquid container comprising:

a housing defining an interior cavity;

an inlet defined by the housing, the inlet receiving a cleaning fluid carrying shaving particles from the cleaning device into the interior cavity;

an outlet through which the cleaning fluid is returned to the cleaning device for further cleaning of the cutter head of the shaving apparatus;

a filter arranged along a flow path of the cleaning fluid between the inlet and the outlet;

an interior wall extending along the interior cavity, the interior wall being arranged to lengthen the flow path of the cleaning fluid between the inlet and the outlet to promote settling of the shaving particles carried by the cleaning fluid within the interior cavity; and wall elements constructed as ribs on at least one inner wall of the cleaning liquid container, wherein a honeycomb-type wall structure is formed by the ribs.

78. A cleaning liquid container for a cleaning device for cleaning a cutter head of a shaving apparatus, the liquid container comprising:

a housing defining an interior cavity;

an inlet defined by a wall of the housing of the cleaning liquid container;

an outlet disposed adjacent the inlet, the outlet being defined by the wall of the housing;

a wall disposed within the interior cavity, the wall being arranged to lengthen a flow path of a cleaning liquid and to direct the flow path across multiple ribs extending upward from a floor wall of the cavity and defining particle retention pockets therebetween, the ribs being constructed as longitudinal partitions; and a filter arranged along the flow path of the cleaning liquid within the interior cavity, the flow path leading from the inlet to the outlet to allow solid particles to settle from the cleaning liquid in the particle retention pockets.

79. A cleaning liquid container for a cleaning device for cleaning a cutter head of a shaving apparatus, the liquid container comprising:

a housing defining an interior cavity;

an inlet defined by a wall of the housing of the cleaning liquid container;

an outlet disposed adjacent the inlet, the outlet being defined by the wall of the housing;

a wall disposed within the interior cavity, the wall being arranged to lengthen a flow path of a cleaning liquid and to direct the flow path across multiple ribs extending upward from a floor wall of the cavity and defining particle retention pockets therebetween; and a filter arranged along the flow path of the cleaning liquid within the interior cavity, the flow path leading from the inlet to the outlet to allow solid particles to settle from the cleaning liquid in the particle retention pockets, wherein a honeycomb-type wall structure is formed by the ribs.

80. A cleaning liquid container for a cleaning device for cleaning a cutter head of a shaving apparatus, the liquid container comprising:

a housing defining an interior cavity;

an inlet defined by a wall of the housing of the cleaning liquid container;

an outlet disposed adjacent the inlet, the outlet being defined by the wall of the housing;

a wall disposed within the interior cavity, the wall being arranged to lengthen a flow path of a cleaning liquid and to direct the flow path across multiple ribs extending upward from a floor wall of the cavity and defining particle retention pockets therebetween;

a filter arranged along the flow path of the cleaning liquid within the interior cavity, the flow path leading from the inlet to the outlet to allow solid particles to settle from the cleaning liquid in the particle retention pockets; and ribs on at least one longitudinal wall.

* * * * *